US011952758B2

(12) United States Patent
Zhou et al.

(10) Patent No.: US 11,952,758 B2
(45) Date of Patent: Apr. 9, 2024

(54) DOUBLE-WATERWAY FAUCET STRUCTURE

(71) Applicant: Xiamen Lota International Co., Ltd., Fujian (CN)

(72) Inventors: Jianping Zhou, Fujian (CN); Shaofeng Li, Fujian (CN); Liming Ye, Fujian (CN); Chuanbao Zhu, Fujian (CN)

(73) Assignee: Xiamen Lota International Co., Ltd., Fujian (CN)

( * ) Notice: Subject to any disclaimer, the term of this patent is extended or adjusted under 35 U.S.C. 154(b) by 183 days.

(21) Appl. No.: 17/724,820

(22) Filed: Apr. 20, 2022

(65) Prior Publication Data

US 2023/0133408 A1 May 4, 2023

(30) Foreign Application Priority Data

Oct. 29, 2021 (CN) ..... 202122635780.5

(51) Int. Cl.
*E03C 1/04* (2006.01)
*E03C 1/02* (2006.01)

(52) U.S. Cl.
CPC ..... *E03C 1/0405* (2013.01); *E03C 2001/026* (2013.01); *E03C 2001/0415* (2013.01); *E03C 2201/40* (2013.01)

(58) Field of Classification Search
CPC ..... E03C 1/0405; E03C 2001/026; E03C 2001/0415; E03C 2201/40
USPC ..... 4/676
See application file for complete search history.

(56) References Cited

U.S. PATENT DOCUMENTS

2007/0235091 A1* 10/2007 Granot ..... E03C 1/0404 137/597
2018/0030700 A1* 2/2018 Zindler ..... E03C 1/0405
2023/0140780 A1* 5/2023 Zhou ..... E03C 1/04 4/676
2023/0193604 A1* 6/2023 Huang ..... E03C 1/041 4/668

FOREIGN PATENT DOCUMENTS

CN 211288924 U 8/2020

* cited by examiner

*Primary Examiner* — Huyen D Le
(74) *Attorney, Agent, or Firm* — Cooper Legal Group LLC

(57) ABSTRACT

A double-waterway faucet structure is provided. A faucet body comprises a first water inlet passage, a second water inlet passage, and a first water outlet passage configured to be in communication with the first water inlet passage, and the first water outlet passage is connected to a pull-out head. A control valve is disposed on the faucet body and is configured to control a turning ON and OFF between the first water inlet passage and the first water outlet passage. A rotating bracket is rotatably disposed on the faucet body and comprises a second water outlet passage configured to be in communication with the second water inlet passage, and a solenoid valve is disposed on the second water inlet passage to control a turning ON and OFF of the second water outlet passage.

9 Claims, 4 Drawing Sheets

DOUBLE-WATERWAY FAUCET STRUCTURE

RELATED APPLICATIONS

This application claims priority to Chinese patent application number 202122635780.5, filed on Oct. 29, 2021. Chinese patent application number 202122635780.5 is incorporated herein by reference.

FIELD OF THE DISCLOSURE

The present disclosure relates to a double-waterway faucet structure.

BACKGROUND OF THE DISCLOSURE

The traditional faucet only has a single water path structure, and the single water path structure is controlled by a single valve to achieve switching, which has a relatively simple water outlet function.

For example, Chinese patent application number 201921346078.3 discloses a dual-purpose faucet for kitchen and water purification, comprising a faucet body, a water purifier, a touch screen assembly, a handle, and a control valve. The faucet body comprises a tap water path and a purified water path. The control valve is installed on the faucet body and can control a turning ON and OFF of the tap water path and a flow rate of water that is flowing in the tap water path. The handle can move relative to the faucet body and is operatively coupled to the control valve. The touch screen assembly comprises a touch screen, a control circuit for the touch screen, and a solenoid valve. The purified water path passes through the water purifier and the solenoid valve. The touch screen is fixed on the faucet body, is located outside the control valve, and is arranged coaxially with the control valve. The control circuit is installed on the faucet body and is electrically connected to each of the touch screen and the solenoid valve. The solenoid valve is electrically connected with the water purifier. Although the dual-purpose faucet has two independent water passages, the faucet body is fixed, the two water passages cannot be rotated according to the required positions, and the two water passages cannot be pulled out for changing a water outlet direction of the two independent water passages, which is inconvenient for a user.

BRIEF SUMMARY OF THE DISCLOSURE

The present disclosure provides a double-waterway faucet structure to solve the deficiencies in the background.

In order to solve the technical problem, a technical solution of the present disclosure is as follows.

A double-waterway faucet structure comprises a faucet body, a rotating bracket, a pull-out head, a solenoid valve, and a control valve. The faucet body comprises a first water inlet passage, a second water inlet passage, and a first water outlet passage configured to be in communication with the first water inlet passage. The first water outlet passage is connected to the pull-out head. The control valve is disposed on the faucet body and is configured to control a turning ON and OFF between the first water inlet passage and the first water outlet passage. The rotating bracket is rotatably disposed on the faucet body and comprises a second water outlet passage configured to be in communication with the second water inlet passage, and the solenoid valve is disposed on the second water inlet passage to control a turning ON and OFF of the second water outlet passage.

In a preferred embodiment, the faucet body comprises a housing body, a valve body, and a fixed sleeve. The valve body is fixedly connected in the housing body. The control valve is disposed in the housing body and matched with the valve body. The fixed sleeve is fixedly connected to the housing body. The rotating bracket comprises a rotating sleeve extending along a vertical direction and a supporting rod fixedly connected to the rotating sleeve and extending along a lateral direction, and the rotating sleeve is rotatably sleeved on an outer periphery of the fixed sleeve. A water-passing passage is defined between the rotating sleeve and the fixed sleeve, the supporting rod comprises the second water outlet passage, and the water-passing passage is in communication with each of the second water inlet passage and the second water outlet passage.

In a preferred embodiment, the double-waterway faucet structure comprises a supporting spring. The supporting spring is fixedly connected to a top end of the rotating sleeve and is configured to rotate with rotation of the rotating sleeve, and the first water outlet passage passes through the housing body, the fixed sleeve, and the supporting spring to extend out of the supporting spring to be connected to the pull-out head.

In a preferred embodiment, the double-waterway faucet structure comprises a first bushing. A top end of the housing body comprises a fixed protrusion extending upward, and a bottom end of the fixed sleeve is disposed in the fixed protrusion. The first bushing is sleeved on an outer periphery of the fixed protrusion, and a bottom end of the rotating sleeve is sleeved on an outer periphery of the first bushing.

In a preferred embodiment, the double-waterway faucet structure comprises a second bushing. The outer periphery of the fixed sleeve comprises a position-limiting protrusion. The second bushing is sleeved on the outer periphery of the fixed sleeve, and a bottom end of the second bushing abuts the position-limiting protrusion. The top end of the rotating sleeve is sleeved on an outer periphery of the second bushing.

In a preferred embodiment, the double-waterway faucet structure comprises a connecting sleeve. An inner wall of the top end of the rotating sleeve comprises a stepped surface, and the connecting sleeve is fixedly connected to the inner wall of the top end of the rotating sleeve. A bottom end of the connecting sleeve abuts the stepped surface, and a bottom end of the supporting spring is sleeved outside the connecting sleeve.

In a preferred embodiment, a distal end of the supporting rod comprises a snapping ring having an opening, and the pull-out head is configured to be detachably snapped to the snapping ring.

In a preferred embodiment, a water purification filter is disposed on the second water inlet passage.

In a preferred embodiment, the first water inlet passage comprises a cold water inlet passage and a hot water inlet passage, and the control valve is configured to control a temperature of water flowing in the first water outlet passage.

Compared with the existing techniques, the technical solution has the following advantages.

1. The double-waterway faucet structure not only has two independently controlled water outlet passages, but also the first water outlet passage is connected to the pull-out head. That is, the double-waterway faucet structure also has a pull-out function, which is more convenient for users to use. At the same time, the second water outlet passage can rotate with rotation of the rotating bracket, and a water outlet direction of the second water outlet passage can be changed according to a position of a water sink, which is more convenient to use.

2. The bottom end of the rotating sleeve is sleeved on the outer periphery of the first bushing, and the top end of the rotating sleeve is sleeved on the outer periphery of the second bushing, which can prevent the rotating sleeve from shaking.

3. The pull-out head can be detachably snapped to the snapping ring, which makes it more convenient to use the pull-out head. When a user has finished using the pull-out head, the pull-out head can be snapped to the snapping ring for positioning.

4. The water purification filter is disposed on the second water inlet passage, so that the second water outlet passage can output purified water.

DETAILED DESCRIPTION OF THE EMBODIMENTS

Figure 1:
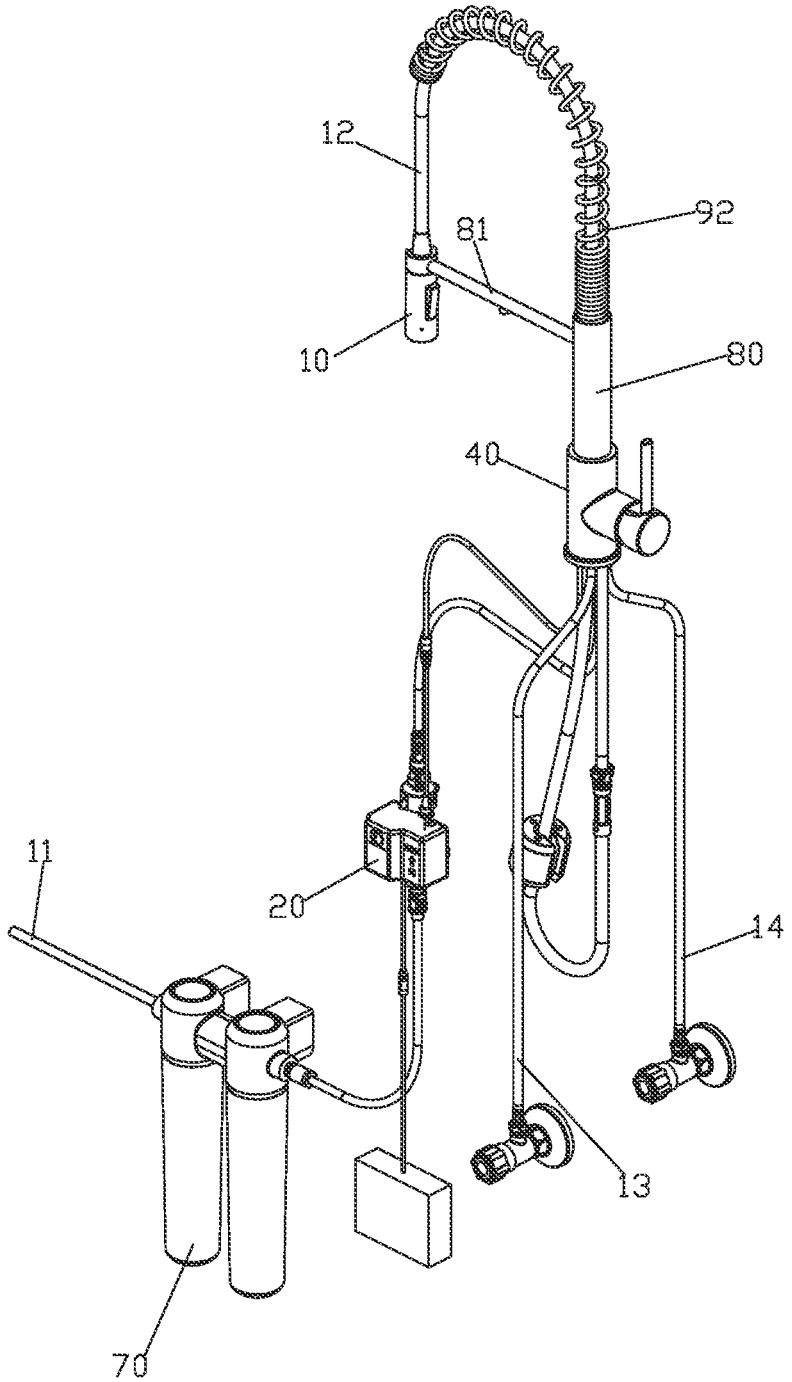
FIG. 1 illustrates an overall, perspective view of a double-waterway faucet structure in a preferred embodiment.
Figure 2:
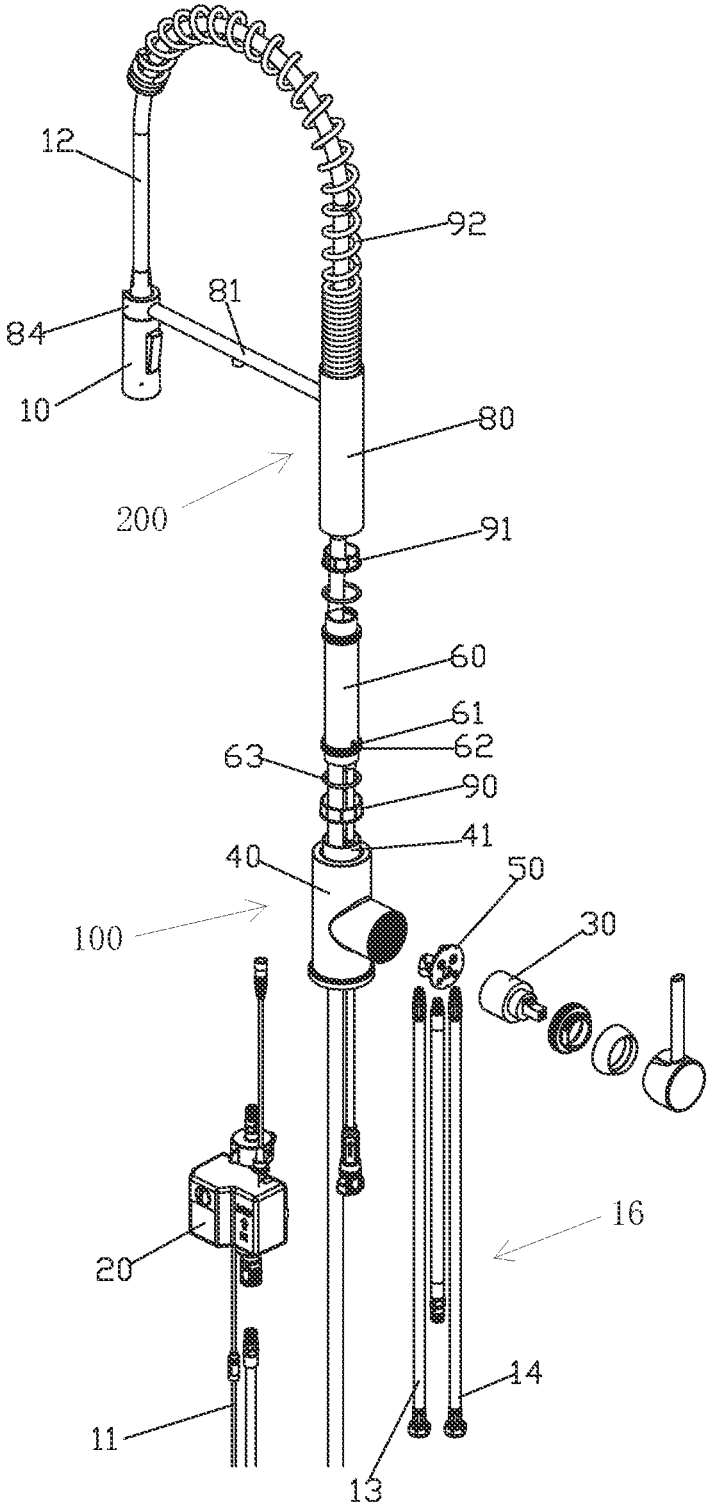
FIG. 2 illustrates an exploded view of the double-waterway faucet structure in a preferred embodiment.
Figure 3:
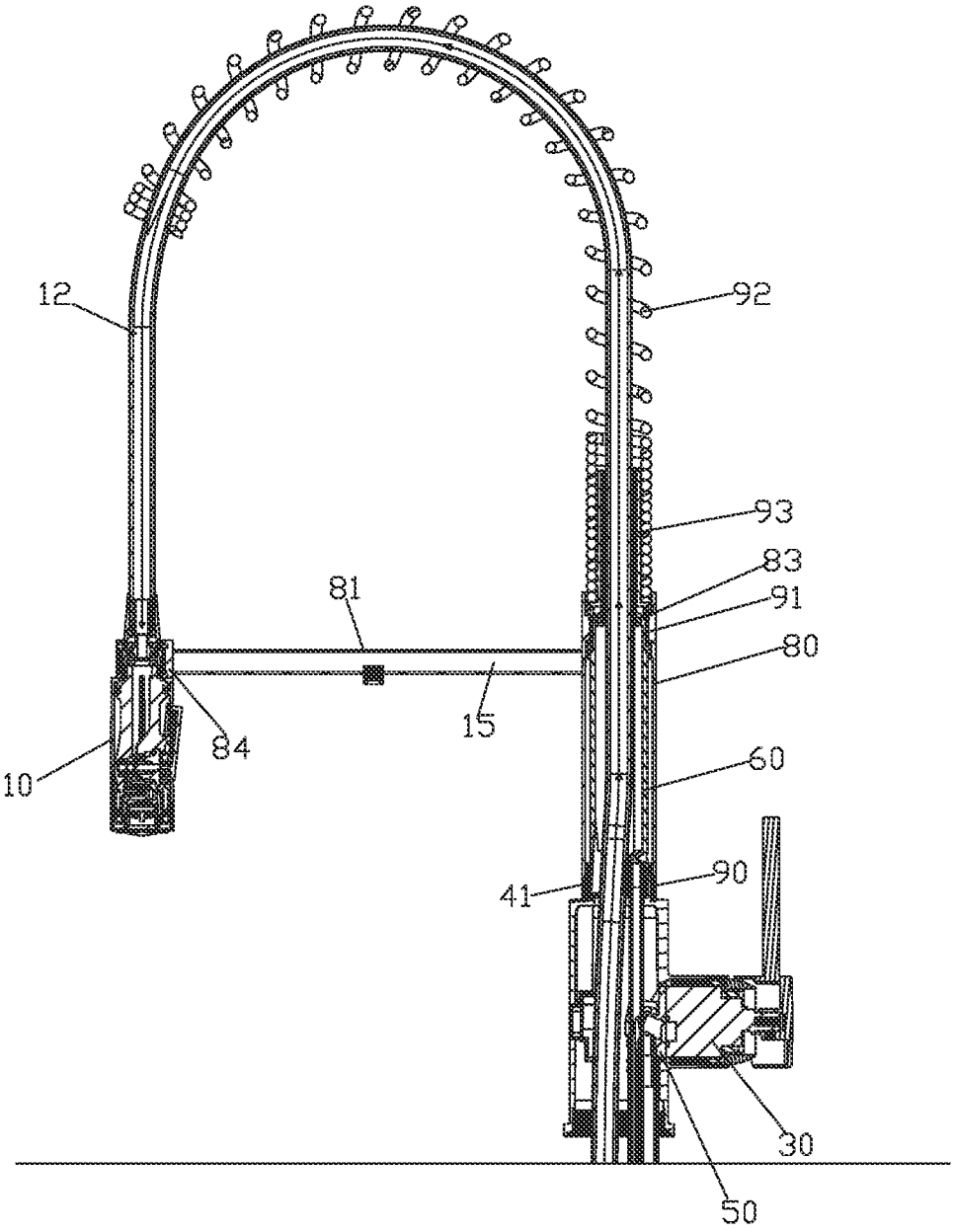
FIG. 3 illustrates a first cross-sectional view of the double-waterway faucet structure in a preferred embodiment.
Figure 4:
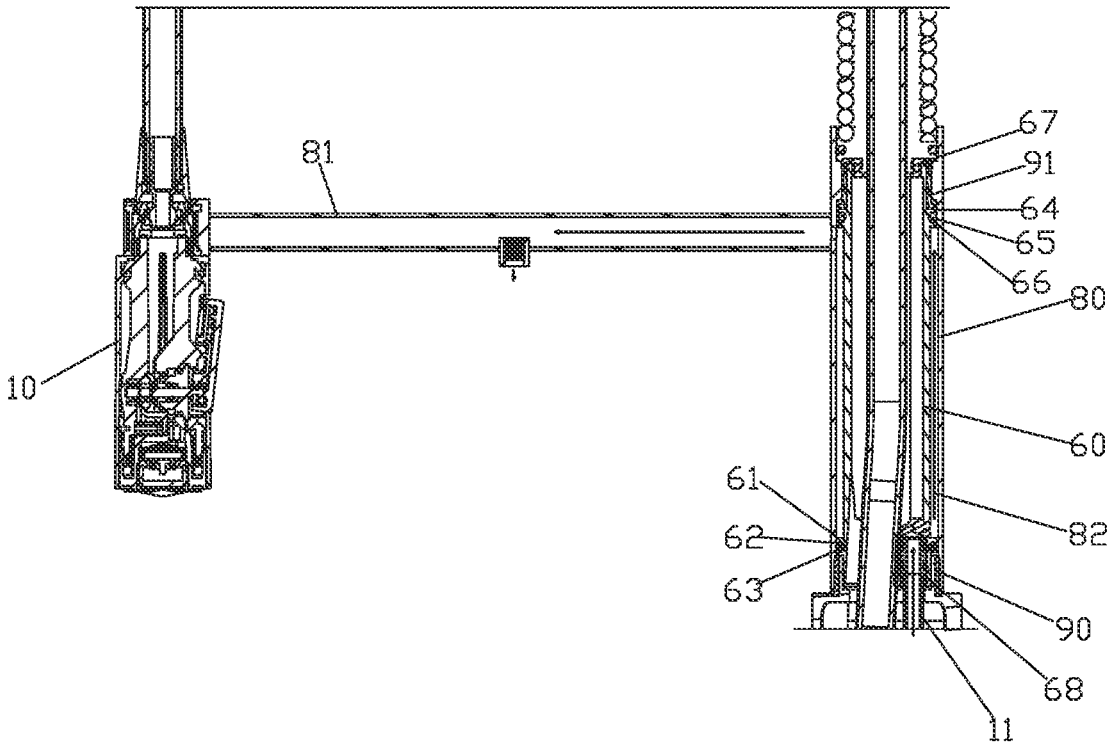
FIG. 4 illustrates a second cross-sectional view of the double-waterway faucet structure in a preferred embodiment.

The present disclosure will be further described below in combination with the accompanying drawings and embodiments.

Unless otherwise clearly defined in the claims, description, and the above-mentioned drawings of the disclosure, the terms "first", "second", "third", and so on are used to distinguish different objects, not used to describe a specific order.

Unless otherwise clearly defined in the claims, description, and the above-mentioned drawings of the disclosure, for location words, such as the use of the terms "center", "transverse", "perpendicular", "horizontal", "vertical", "top", "bottom", "inner", "outer", "upper", "lower", "front", "rear", "left", "right", "clockwise", "counterclockwise", and other indication orientations or positional relationships are based on the orientations and positional relationships shown in the drawings, are provided to facilitate the description of the disclosure and simplify the description, and are not intended to indicate or imply that the indicated device or element must have a specific orientation or be constructed and operated in a specific orientation. Such words should not be understood as limiting the specific protection scope of the disclosure.

In the claims, the description, and the drawings of the present disclosure, unless otherwise explicitly defined, if the term "fixed connection" or "fixedly connected" is used, it should be understood in a broad sense. That is, any connection method without displacement relationship and relative rotation relationship between the two, that is, including non-removable fixed connection, removably fixed connection, connected as a whole, and fixed connection through other devices or components.

In the claims, the description, and the drawings of the present disclosure, the terms "including", "having", and their variations are intended to mean "including but not limited to".

Referring to FIGS. 1 to 4, a preferred embodiment of a double-waterway faucet structure is provided. The double-waterway faucet structure comprises a faucet body 100, a rotating bracket 200, a pull-out head 10, a solenoid valve 20, and a control valve 30.

The faucet body comprises a first water inlet passage 16, a second water inlet passage 11, and a first water outlet passage 12 configured to be in communication with the first water inlet passage. The first water outlet passage 12 is connected to the pull-out head 10, and the control valve 30 is installed on the faucet body and can control a turning ON and OFF between the first water inlet passage and the first water outlet passage 12.

In this embodiment, the faucet body further comprises a housing body 40, a valve body 50, and a fixed sleeve 60. The valve body 50 is fixedly connected inside of the housing body 40. The control valve 30 is installed in the housing body 40 and is matched with the valve body 50. The fixed sleeve 60 is fixedly connected to the housing body 40.

Specifically, the first water inlet passage comprises a cold water inlet passage 13 and a hot water inlet passage 14. The control valve 30 can also control a temperature of water flowing in the first water outlet passage 12. Each of the cold water inlet passage 13, the hot water inlet passage 14, and the first water outlet passage 12 is plugged into the valve body 50. The housing body 40 is a three-way structure, and the control valve 30 is inserted into the housing body 40 from a side of the housing body 40 to be matched with a side of the valve body 50. The connection parts among the control valve 30, the valve body 50, and the housing body 40 are in the prior art and will not be repeated here.

In this embodiment, a water purification filter 70 is disposed on the second water inlet passage 11, so that the second water outlet passage 15 discharges purified water. Referring to FIG. 1, the water purification filter 70 is located upstream of the solenoid valve 20.

The rotating bracket is rotatably connected to the faucet body and comprises a second water outlet passage 15 configured to be in communication with the second water inlet passage 11. The solenoid valve 20 is installed on the second water inlet passage 11 to control a turning ON and OFF of the second water outlet passage 15.

In this embodiment, the rotating bracket further comprises a rotating sleeve 80 extending along a vertical direction and a supporting rod 81 fixedly connected to the rotating sleeve 80 and extending along a lateral direction. The rotating sleeve 80 is rotatably sleeved on an outer periphery of the fixed sleeve 60, and a water-passing passage 82 is formed between the rotating sleeve 80 and the fixed sleeve 60. The supporting rod 81 comprises the second water outlet passage 15, and the water-passing passage 82 is in communication with the second water inlet passage 11 and the second water outlet passage 15.

In this embodiment, the double-waterway faucet structure further comprises a first bushing 90. A top end of the housing body 40 comprises a fixed protrusion 41 extending upward, and a bottom end of the fixed sleeve 60 is inserted into the fixed protrusion 41. The first bushing 90 is sleeved on an outer periphery of the fixed protrusion 41, and a bottom end of the rotating sleeve 80 is sleeved on an outer periphery of the first bushing 90. Specifically, referring to FIG. 3, an outer periphery of the bottom end of the fixed sleeve 60 comprises a position-limiting block 61, and a top end of the fixed protrusion 41 abuts the position-limiting block 61. In order to ensure sealing between the rotating sleeve 80 and the position-limiting block 61, an outer periphery of the position-limiting block 61 comprises an annular groove 62 to receive a sealing ring 63.

In this embodiment, the double-waterway faucet structure further comprises a second bushing 91. The outer periphery of the fixed sleeve 60 comprises a position-limiting protrusion 64, and the second bushing 91 is sleeved on the outer periphery of the fixed sleeve 60. A bottom end of the second bushing 91 abuts the position-limiting protrusion 64, and a top end of the rotating sleeve 80 is sleeved on an outer periphery of the second bushing 91. In order to ensure sealing between the position-limiting protrusion 64 and the rotating sleeve 80, an outer periphery of the position-limiting protrusion 64 comprises an annular groove 65 to receive a sealing ring 66. A joint 67 is threadedly connected to a top end of the fixed sleeve 60, and the joint 67 can inhibit movement of the second bushing 91. The bottom end of the fixed sleeve 60 comprises a plugged port 68 in communication with the water-passing passage 82, and the plugged port 68 is pluggably matched with the second water inlet passage 11.

In this embodiment, the double-waterway faucet structure further comprises a supporting spring 92, and the supporting spring 92 is fixedly connected to the top end of the rotating sleeve 80 and can rotate with rotation of the rotating sleeve 80. The first water outlet passage 12 passes through the housing body 40, the fixed sleeve 60, and the supporting spring 92 to extend out of the supporting spring 92 to be connected to the pull-out head 10.

In this embodiment, the double-waterway faucet structure further comprises a connecting sleeve 93. An inner wall of the top end of the rotating sleeve 80 comprises a stepped surface 83. The connecting sleeve 93 is fixedly connected to the inner wall of the top end of the rotating sleeve 80, and a bottom end of the connecting sleeve 93 abuts the stepped surface 83. A bottom end of the supporting spring 92 is sleeved outside the connecting sleeve 93.

In this embodiment, a distal end of the supporting rod 81 comprises a snapping ring 84 having an opening, and the pull-out head 10 can be detachably snapped to the snapping ring 84.

The first water inlet passage of the double-waterway faucet structure is independently controlled by the control valve 30, and the second water inlet passage 11 is independently controlled by the solenoid valve 20. The first water inlet passage and the second water inlet passage 11 are independent of each other and do not interfere with each other. Meanwhile, the first water outlet passage 12 can be pulled out for changing a water output direction, and the second water outlet passage 15 can rotate for changing a water output direction, which is more convenient to use.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A double-waterway faucet structure, comprising:
a faucet body,
a rotating bracket,
a pull-out head,
a solenoid valve, and
a control valve, wherein:
the faucet body comprises a first water inlet passage, a second water inlet passage, and a first water outlet passage configured to be in communication with the first water inlet passage,
the first water outlet passage is connected to the pull-out head,
the control valve is disposed on the faucet body and is configured to control a turning ON and OFF between the first water inlet passage and the first water outlet passage,
the rotating bracket is rotatably disposed on the faucet body and comprises a second water outlet passage configured to be in communication with the second water inlet passage, and
the solenoid valve is disposed on the second water inlet passage to control a turning ON and OFF of the second water outlet passage.

2. The double-waterway faucet structure according to claim 1, wherein:
the faucet body comprises a housing body, a valve body, and a fixed sleeve,
the valve body is fixedly connected in the housing body,
the control valve is disposed in the housing body and matched with the valve body,
the fixed sleeve is fixedly connected to the housing body,
the rotating bracket comprises a rotating sleeve extending along a vertical direction and a supporting rod fixedly connected to the rotating sleeve and extending along a lateral direction,
the rotating sleeve is rotatably sleeved on an outer periphery of the fixed sleeve,
a water-passing passage is defined between the rotating sleeve and the fixed sleeve,
the supporting rod comprises the second water outlet passage, and
the water-passing passage is in communication with each of the second water inlet passage and the second water outlet passage.

3. The double-waterway faucet structure according to claim 2, comprising:
a supporting spring, wherein:
the supporting spring is fixedly connected to a top end of the rotating sleeve and is configured to rotate with rotation of the rotating sleeve, and
the first water outlet passage passes through the housing body, the fixed sleeve, and the supporting spring to extend out of the supporting spring to be connected to the pull-out head.

4. The double-waterway faucet structure according to claim 3, comprising:
a first bushing, wherein:
a top end of the housing body comprises a fixed protrusion extending upward,
a bottom end of the fixed sleeve is disposed in the fixed protrusion,
the first bushing is sleeved on an outer periphery of the fixed protrusion, and
a bottom end of the rotating sleeve is sleeved on an outer periphery of the first bushing.

5. The double-waterway faucet structure according to claim 4, comprising:
a second bushing, wherein:
the outer periphery of the fixed sleeve comprises a position-limiting protrusion,
the second bushing is sleeved on the outer periphery of the fixed sleeve,
a bottom end of the second bushing abuts the position-limiting protrusion, and
the top end of the rotating sleeve is sleeved on an outer periphery of the second bushing.

6. The double-waterway faucet structure according to claim 3, comprising:

a connecting sleeve, wherein:

an inner wall of the top end of the rotating sleeve comprises a stepped surface, the connecting sleeve is fixedly connected to the inner wall of the top end of the rotating sleeve, a bottom end of the connecting sleeve abuts the stepped surface, and a bottom end of the supporting spring is sleeved outside the connecting sleeve.

7. The double-waterway faucet structure according to claim 2, wherein:

a distal end of the supporting rod comprises a snapping ring having an opening, and the pull-out head is configured to be detachably snapped to the snapping ring.

8. The double-waterway faucet structure according to claim 2, wherein:

a water purification filter is disposed on the second water inlet passage.

9. The double-waterway faucet structure according to claim 2, wherein:

the first water inlet passage comprises a cold water inlet passage and a hot water inlet passage, and the control valve is configured to control a temperature of water flowing in the first water outlet passage.

* * * * *